United States Patent [19]

Anderson

[11] Patent Number: 4,665,829

[45] Date of Patent: May 19, 1987

[54] GUIDEWAY CONSTRUCTION AND METHOD OF INSTALLATION

[75] Inventor: J. Edward Anderson, Minneapolis, Minn.

[73] Assignee: Regents of the University of Minnesota, Minneapolis, Minn.

[21] Appl. No.: 890,881

[22] Filed: Jul. 28, 1986

Related U.S. Application Data

[63] Continuation of Ser. No. 463,951, Feb. 4, 1983, abandoned.

[51] Int. Cl.[4] ..... B61B 5/00

[52] U.S. Cl. ..... 104/124; 104/125; 14/13

[58] Field of Search ..... 104/118, 124, 125, 119, 104/123; 14/3, 4, 13, 16.1; 52/69, 71, 693

[56] References Cited

U.S. PATENT DOCUMENTS

| | | | |
|---|---|---|---|
| 448,571 | 3/1891 | Jacobs | 104/124 |
| 604,729 | 5/1898 | Cooley | 104/119 |
| 629,273 | 7/1899 | Rieppel | 104/124 |
| 786,874 | 4/1905 | Cooper | 104/123 |
| 937,338 | 10/1909 | Strauss | 104/124 |
| 1,176,994 | 3/1916 | Spelling | 14/4 |
| 1,761,824 | 6/1930 | Goodrich | 104/118 |
| 1,998,205 | 4/1935 | Roscher | 104/124 |
| 2,014,430 | 9/1935 | Fish | 104/125 |
| 2,055,971 | 9/1936 | Fraser | 104/124 |
| 2,571,337 | 10/1951 | Burnham | 104/124 |
| 2,945,248 | 7/1960 | Meagher | 14/16.1 |
| 3,236,192 | 2/1966 | Esquillan | 104/124 |
| 3,906,863 | 9/1975 | Baldelli | 104/88 |

FOREIGN PATENT DOCUMENTS

| | | | |
|---|---|---|---|
| 580635 | 8/1959 | Canada | 14/13 |
| 646292 | 8/1962 | Canada | 104/118 |
| 2173266 | 10/1973 | France . | |
| 2206408 | 6/1974 | France . | |
| 2239367 | 2/1975 | France . | |
| 0159912 | 12/1979 | Japan | 104/125 |
| 1206682 | 9/1970 | United Kingdom . | |

OTHER PUBLICATIONS

Jack H. Irving, Ph. D., Fundamentals of Personal Rapid Transit, 1978, pp. 198–235.

J. Edward Anderson, Personal Rapid Transit II, 1974, pp. 87–91.

International Transit Compendium, 1983, pp. 125–127, Cabtrack Studies System Concept & Design, 1970.

White River Park Transit System, winter 1983.

Civil Engineering, vol. 15, No. 11, Nov. 1945, pp. 513–515.

Brochure by Personal Rapid Transit Corporation, Sep. 7, 1982.

*Primary Examiner*—Robert B. Reeves

*Assistant Examiner*—Dennis H. Pedder

*Attorney, Agent, or Firm*—Merchant, Gould, Smith, Edell, Welter, Schmidt

[57] ABSTRACT

The guideway is comprised of upper horizontal stringers (20, 22), lower horizontal stringers (24, 26) vertically oriented diagonal members (30, 32) affixed to the upper and lower horizontal stringers (20, 22 and 24, 26) and horizontally oriented diagonal members (34) are affixed between the lower horizontal stringers (24, 26). These features present a guideway having an upwardly extending U-shape construction which can be supplied with wheel supporting channels (28), upper support channels (35) and the entire structure can be reinforced by ribs (60) and enclosed by a cover (50). The ribs include spaced inner and outer members with joined free ends. A method of installation includes (1) installing the post means; (2) positioning the guideway sections over the post means; (3) lowering the guideway sections; (4) clamping the sections to the post means at four points; (5) repeating steps 2–4 for the adjacent post means and (6) affixing the sections in end-to-end relationship to form a continuous elevated guideway.

8 Claims, 11 Drawing Figures

10
12
14
16
18
20
24
30
32
35
38
40
42
50
52
60
7
7
82
84

20
24
26
30
32
34
40
42
60
64
70
72
81
82
83
84
85

GUIDEWAY CONSTRUCTION AND METHOD OF INSTALLATION

This is a continuation of application Ser. No. 463,951, filed Feb. 4, 1983, abandoned.

TECHNICAL FIELD

This invention relates generally to the field of vehicle supporting guideways and particularly to a guideway having a generally U-shaped upwardly opening cross section for supporting personal rapid transit vehicles.

BACKGROUND OF THE INVENTION

This invention is related to an earlier filed co-pending application Ser. No. 456,860, now U.S. Pat. No. 4,522,128, filed Jan. 10, 1983 entitled Switch Mechanism.

With the increase in fuel costs and escalating construction costs for automobile-type surface roads, the need for fuel efficient, economical rapid transit has increased. The state of mass transit at present includes surface buses and surface railway systems as well as underground subway trains as well as elevated trains and the like. All of these systems attempt to move large numbers of people in large vehicles.

Consequently, the vehicle must stop at a plurality of stations to allow passengers to embark and disembark as desired. Therefore, the effective average speed of the vehicle is reduced by constant stopping and starting, and most passengers make numerous stops between the point they get on the vehicle and their intended destination.

A personal rapid transit system would eliminate several of these problems as each vehicle carries a small number of passengers desiring to go to the same destination, and each vehicle bypasses all intermediate stops. Therefore, the average speed of the vehicle can be greatly increased while its maximum speed remains the same, and delays associated with stopping at intermediate points are eliminated. The advantages of this design have been known to those skilled in the art, but the construction of a guideway system which could be constructed economically and which was durable enough to be practical has eluded those in the art.

General background information on transit systems can be found in the *Journal of Advanced Transportation,* specifically volume 15, No. 2 dated Summer, 1981; *Fundamentals of Personal Rapid Transit* by Jack H. Irving, Ph.D., published in 1978 by D. C. Heath and Co., Lexington, Mass.; and *Environment,* specifically Volume 22, No. 8, dated October, 1980, which includes an article entitled "Personal Rapid Transit". Additional information on this subject can be found in the books *Personal Rapid Transit I, Personal Rapid Transit II* and *Personal Rapid Transit III* published at the University of Minnesota, Minneapolis, Minn., in April 1972, February 1974, and June 1976, respectively.

The elimination of the requirement that a vehicle stop at all intermediate points generally requires that all stopping points be wayside stations or be located on sidings or similarly removed from the main track so that stopped vehicles do not hinder the passage of through vehicles. Therefore, the construction of a track or guideway for this type of system is challenging.

The construction of a guideway system supported above the ground offers several advantages to track systems located either on the ground or below ground.

The below ground system offers the obvious disadvantage of requiring tunneling or other expensive right-of-way preparation. Surface tracks also require substantial site grading and right-of-way preparation, and lead to annoying vibration transmitted to nearby structures and people. Grade level tracks are also dangerous to cross traffic and require crossing gates and safety lights. An elevated guideway offers obvious advantages, but the construction of an elevated guideway suitable for use with a personal rapid transit system is challenging.

The problems associated with an above ground installation for a guideway system having wayside stations are numerous, and include the problems associated with harmonic oscillation of the guideway as vehicles pass along its length. The construction of a lightweight guideway strong enough to support a number of individual vehicles passing at moderate or rapid speeds poses a serious oscillation problem. Damping of harmonic oscillation frequencies generally requires an increased guideway mass which further complicates the oscillation problems and increases the cost of the guideway.

It is also desirable to construct the guideway in a prefabricated manner to save on construction and erection costs. Typically, prefabricated guideways suffer from their inability to cope with oscillation. This problem is exacerbated by the typical construction which places guideway supporting posts beneath the ends of each guideway section so that the point of support of each section is the same as its point of attachment to adjacent guideway sections. This construction design causes the center of each guideway section to oscillate with the guideway support posts functioning as node points in the oscillation wave along the length of the guideway.

Oscillation of the guideway creates numerous problems including the requirement for reinforcement structures along the guideway, thereby increasing the guideway's weight and cost. When the weight of the guideway is increased, the oscillation mass is also increased thereby aggrevating the problem. Additionally, oscillation of the guideway greatly detracts from ride comfort within the vehicle, and accelerates wear of the guideway itself caused by flexing. For example, U.S. Pat. No. 3,225,703 issued Dec. 28, 1965 illustrates a device having beams affixed at their ends to support columns. This type of device includes dash pot like devices to manage force transmission between adjacent beams.

As the success of the rapid transit system depends directly on the confidence its ridership has in the functioning and structure of the system, the elimination of oscillation and its associated problems is critical to the construction of an economically feasible and viable guideway and transportation system.

SUMMARY OF THE INVENTION

A transportation system for use with a wheeled vehicle for carrying passengers along a vehicle supporting elevated guideway is disclosed. The guideway includes a plurality of guideway sections linked in end to end relationship. Each section has a pair of upper horizontal stringers located parallel to each other. These upper horizontal stringers generally define the width of the guideway and are placed parallel to and above a pair of lower horizontal stringers. The four stringers run the length of the guideway. A plurality of vertically oriented diagonal members are affixed to the upper and lower horizontal stringers, the diagonal members lying in vertical planes between respective pairs of horizontal stringers. A plurality of horizontally oriented diagonal members are affixed to and join the lower horizontal stringers so that the sides and the bottom are joined by diagonal members forming a generally upwardly extending U-shaped configuration for the guideway.

The guideway thus described further includes a plurality of guideway supporting posts, one placed below each guideway section. The guideway further includes U-shaped reinforcement ribs, and an all-weather cover which aesthetically covers the guideway. The guideway sections are joined in end-to-end relation with expansion joints at the connection points, and the connection points are located substantially at one of the points of zero bending moment within the guideway between adjacent posts.

DETAILED DESCRIPTION OF THE PREFERRED EMBODIMENT

Figures 1, 2, 3:
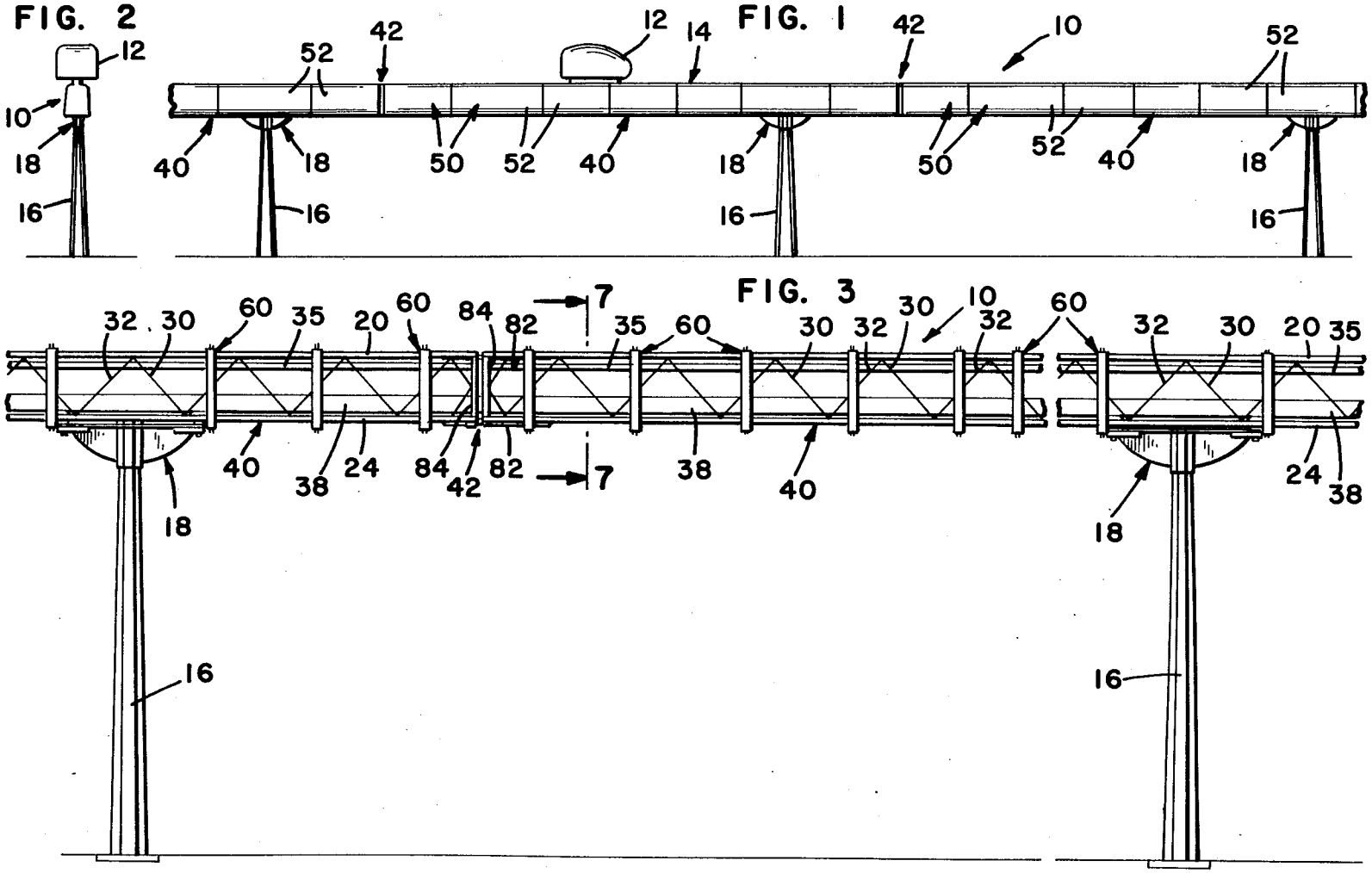
FIG. 1 is a partial side elevational view of the present guideway invention.
FIG. 2 is an end elevational view of the guideway shown in FIG. 1.
FIG. 3 is a slightly enlarged partial elevational view of the guideway structure having the covers removed.
Figure 4:
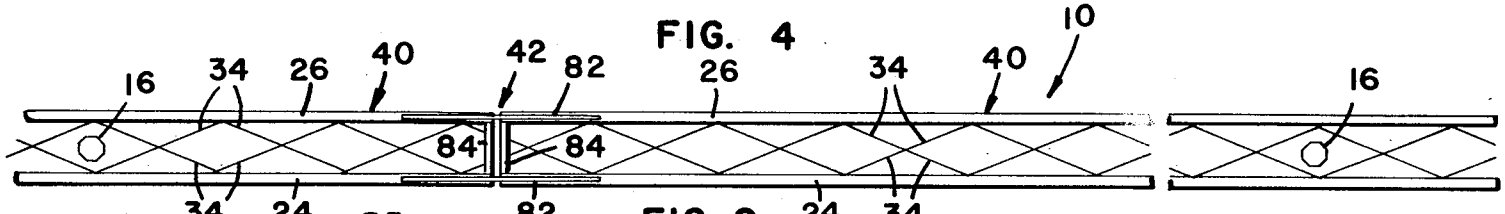
FIG. 4 is a partial diagramatic bottom view of the guideway shown in FIG. 3.

In reference now to the drawings wherein like reference numerals correspond to similar components throughout the several views, the guideway 10 is shown in FIG. 1 supporting a vehicle 12, and having a track portion 14 held above the ground by posts 16 with support brackets 18 therebetween.

The vehicle 12 includes a body portion and a bogie portion. The bogie travels substantially within the guideway on wheels, and the vehicle is powered by linear induction motors which are affixed to the vehicle. Details of the vehicle are not shown.

The structure shown in FIG. 1 represents a transportation system for use with a wheeled vehicle 12 supported on the guideway 10. The guideway 10 forms a generally open truss having an upwardly opening U-shaped cross section. (See for example FIG. 7.) The guideway is composed of a number of guideway sections 40 affixed in end to end relation forming a continuous guideway. Each guideway section is supported by a guideway support post 16. Expansion joints 42 are located substantially at the points of zero bending moment within the guideway. The science of statics defines the points of zero bending moment of a uniformly loaded beam with clamped ends as points lying approximately twenty one percent of the beam's total length inwardly from each end of the beam. In other words, the points of zero bending moment lie at points approximately 21% and 79% along the length of a uniformly loaded beam.

Figure 7:
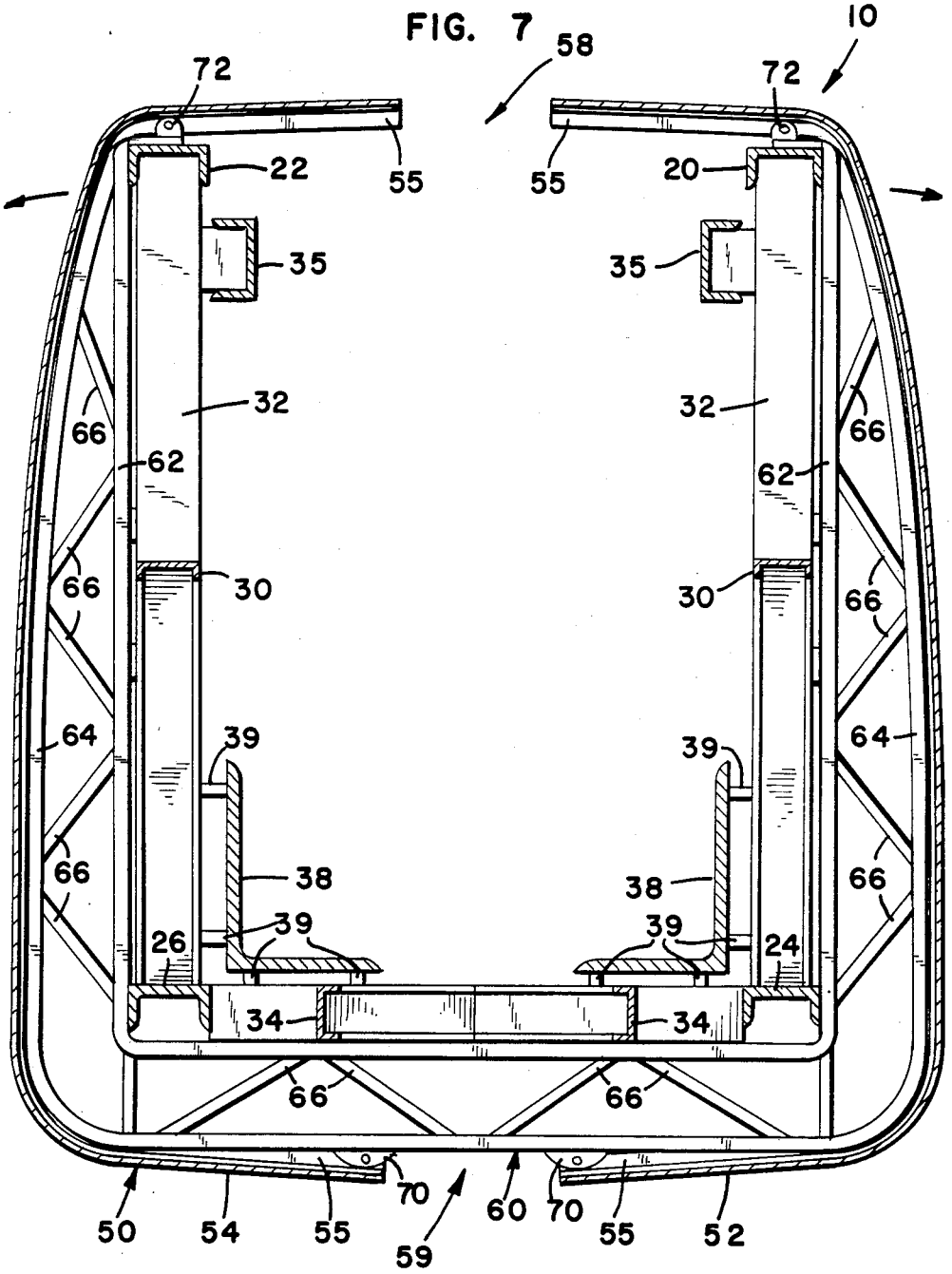
FIG. 7 is a cross sectional view taken along line 7—7 in FIG. 3 shown on an enlarged scale.

As shown in FIG. 7, the guideway consists of a pair of upper horizontal stringers 20 and 22 located parallel to each other and generally defining the width of the guideway 10. A pair of lower horizontal stringers 24 and 26 are located parallel to each other and are placed parallel to and below the upper horizontal stringers 20 and 22 respectively.

Figures 5, 6:
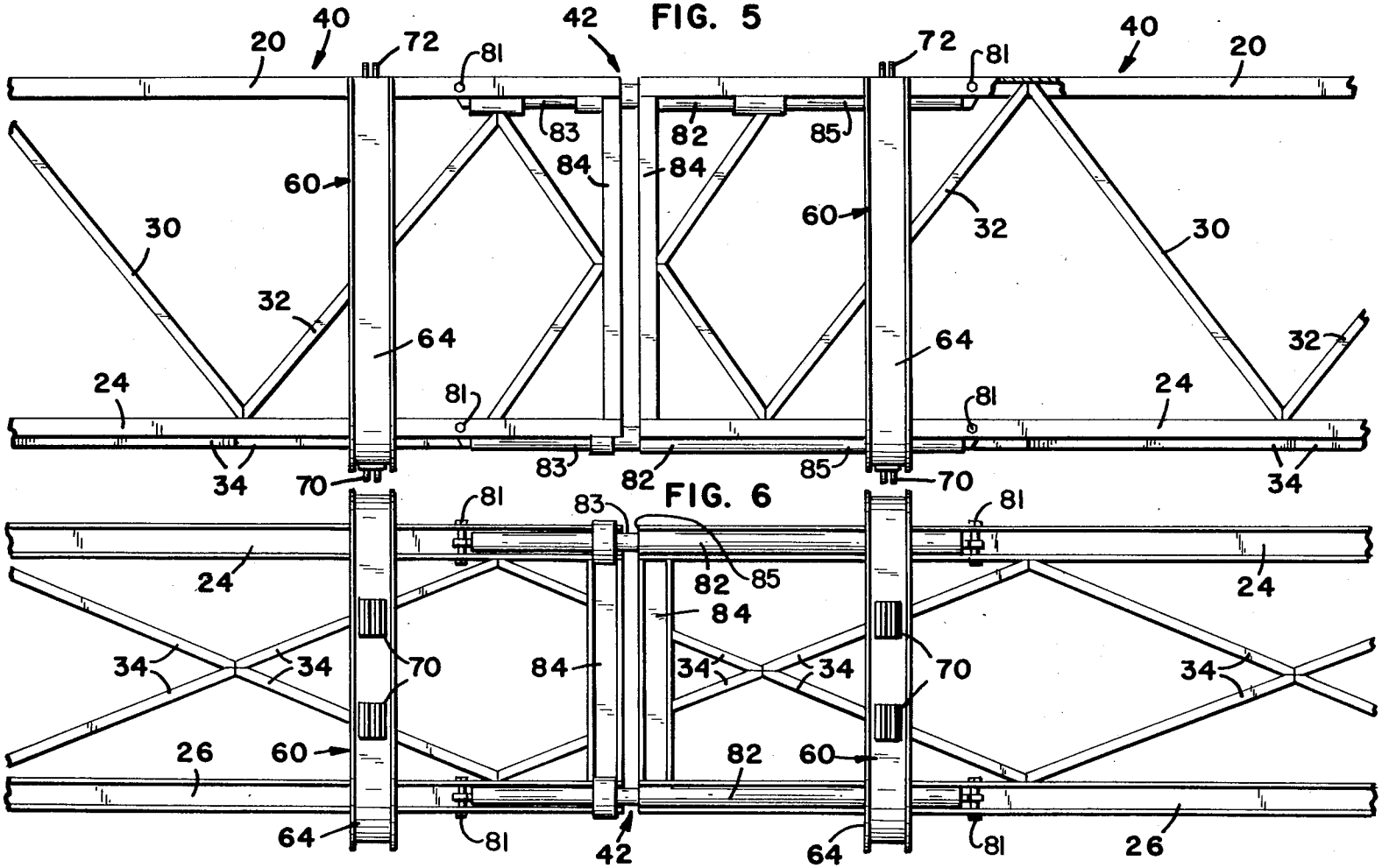
FIG. 5 is a partial diagramatic side elevational view of an expansion joint within the guideway shown on an enlarged scale.
FIG. 6 is a bottom diagramatic view of the expansion joint shown in FIG. 5.

A plurality of vertically oriented diagonal members 30 and 32 are affixed to the upper and lower horizontal stringers 20 and 24, or 22 and 26 as shown in FIG. 5 and form a triangular pattern. A plurality of horizontally oriented diagonal members 34 are affixed to join each of the lower horizontal stringers 24 and 26 and form a diamond pattern. In this way, the guideway 10 is defined as a generally upwardly extending, U-shaped structure having upper horizontal stringer 22 and lower horizontal stringer 26 with vertical diagonal members 30 and 32 therebetween defining one vertical leg of the U. Horizontal stringers 26 and 24 with horizontal diagonal members 34 therebetween define the base of the U, with stringers 24 and 20 with vertical diagonal members 30 and 32 therebetween defining the second upright leg of the U.

A pair of main wheel support channels 38 (made of right angle "L" shaped members) are affixed to the guideway above the horizontal diagonal members 34. The support channels 38 lie generally between the vertical diagonal members 30 and 32 and are adjustable both horizontally and vertically within the U-shaped guideway.

The support channels 38 are adjustable with adjusting bolts or shims 39 which lie between the support channels 38 and the guideway 10. These adjusting bolts or shims 39 are placed along the horizontal diagonal members 34 below support channel 38 and on the inside surface of the vertical diagonal members 30 and 32 so as to contact the main support channels 38. These bolts or shims provide a means for adjusting the relative position of the main wheel support channel above and between the horizontal and vertical diagonal members respectively. In this way, a perfectly aligned vehicle carrying support track formed by the support channels 38 can be maintained. Fine adjustments of the support channels 38 within the guideway 10 are possible without the need for expensive, time consuming and difficult alignment of repairs to the guideway itself. The guideway is also provided with upper support channels 35 which stabilize the vehicle as it passes through the guideway.

In reference now to FIGS. 1 and 2, the guideway structure is composed of a plurality of guideway sections 40, each of substantially uniform length. The guideway sections 40 are affixed in end-to-end relation at junction points 42 forming a continuous guideway. The guideway sections 40 are themselves elevated above the ground a desired distance. This elevation is accomplished by a plurality of support posts 16. Each one of the support posts 16 is affixed beneath each guideway section 40. Expansion joints 42 are near the point of zero bending moment of the guideway.

The guideway structure composed of the upper stringers 20 and 22, and the lower stringers 24 and 26, respectively, are additionally stiffened by the application of reinforcing ribs 60 spaced along the length of each guideway section 40. The reinforcing ribs 60 are connected to each of the stringers running the length of the guideway sections and are also attached to the vertical diagonal members 32. The reinforcing ribs 60 provide torsional stiffness to the guideway and thereby increase the natural frequency of oscillation of the guideway to torsional twisting. Therefore the resistance of the guideway to side wind loads and unevenly loaded vehicles is increased.

The reinforcing ribs 60 contact and stiffen the vertical diagonal members 32 which are held in compression within each guideway section 40. The remaining vertical diagonal members 30 are held in tension within the guideway. The weight of the guideway sections themselves, of course, exert forces along the truss structure of the guideway sections 40. These forces hold the vertical diagonal members 30 in tension in that a pulling force is exerted along their length, and the vertical diagonal members 32 are held in compression with a pushing force exerted upon their length. By placing the reinforcing ribs 60 to cross approximately in the middle of the vertical diagonal members 32, the resistance of members 32 to buckling is increased four-fold. The resistance of a member under compression to buckling increases by a factor of four as the length of the member is reduced by a factor of two. Therefore, significant strength is added to the guideway sections 40 without increasing the beam's weight by placing the reinforcing rib 60 to intersect and stiffen the vertical diagonal members under compression.

In reference now to FIG. 7, the reinforcing ribs 60 themselves are composed of an inner channel 62 having a generally U-shape and conforming closely to the dimensions and configuration of the guideway as defined by the upper and lower stringers 20–26, respectively. The reinforcing rib 60 also includes an outer channel 64 having a generally U-shaped configuration. The outer channel is joined at its free ends to the free ends of the inner channel 62. The outer channel 64 is of somewhat longer length than the inner channel and is spaced therefrom along its length except near the free ends of the inner and outer channels 62 and 64 respectively. The inner and outer channels 62 and 64 are located with respect to each other by a stiffening bar or channel 66 which is affixed to the inner and outer channels 62 and 64 in alternating fashion forming a plurality of triangular shaped openings between the channels. This design provides a reinforcing rib 60 which provides significant torsional stiffness to the guideway.

It is expected that a guideway constructed with the design described above will provide a guideway having the lightest overall weight for its load bearing capacity. Light guideway weight with a large load bearing capacity has the advantange of providing a guideway which has a sufficiently high natural frequency of oscillation to allow suitable vehicle speeds. For example, a guideway constructed of a heavy material may prove to have a natural frequency of oscillation of one cycle per second. Assuming a guideway section length of sixty feet or twenty meters, a vehicle speed of only twenty meters per second could be sufficient to cause serious oscillation problems. These problems are caused by the natural oscillation of the guideway being amplified by the passage of the vehicle over the guideway at a speed corresponding to the natural oscillation frequency, i.e. one guideway section per second. This problem is further increased by a guideway design which places support posts only beneath the joints of adjacent guideway sections.

A guideway having a significantly higher natural oscillation frequency, (for example an open truss design being supported by posts, and having expansion joints between guideway sections near the points of zero bending moment of the guideway) can support a vehicle moving at greater speeds without oscillation problems. Oscillation problems cause wear to the guideway due to flexing and bending, and more importantly decrease ride comfort for the passengers, as the passengers are exposed to vertical accelerations as the guideway oscillates. Additionally, the guideway constructed along the design above described will be economical to produce and maintain.

The guideway itself is substantially enclosed by a cover 50 having a first half 52 and a second half 54. (See FIGS. 1 and 7.) The cover halves are hingedly affixed to the reinforcing ribs 60 along the length of the guideway 10. The cover halves 52 and 54 are hinged at the bottom of the outer bar 64 of the reinforcing ribs 60 at hinge points 70. The hinge points 70 are located slightly offset from the center of the outer bar 64. The cover halves 52 and 54 are pinned or otherwise affixed to the tops of the upper stringers 20 and 22, respectively, at pin points 72. The cooperation of the pin fixture points 72 and the hinges 70 allow the covers to be folded back for easy access to the guideway sections 40 for maintenance procedures and the like. The cover halves 52 and 54 are stiffened by stiffening ribs 55 (See FIG. 8) which provide strength for the attachment of the hinges and pins 70 and 72. Stiffening ribs 55 are of "T" shaped cross-section. The cover 50 is segmented, meaning it is composed of a large number of smaller pieces each spanning a distance of approximately the span between three reinforcing ribs 60. In this way convenient access to the guideway is provided, with the cover halves being of manageable size.

It should be noted, that the cover 50 substantially encloses the guideway but for an upper slit 58 and a lower slit 59. The upper slit provides a continuous opening running the length of the guideway for passage of the support vehicle. The lower slit 59 allows rain, snow, debris and other material which may find its way into the guideway to pass out of the guideway. The cover 50 greatly reduces the amount of such material which finds its way into the guideway. Additionally, the cover improves the aesthetic appearance of the guideway structure. Additionally, the cover protects the guideway from lightning which can damage the electrical wiring within the guideway used to power and control the vehicles 12. The cover 50 also protects the guideway support channels 38 and the power rails from the night time sky which can produce frost on exposed surfaces during cool weather. The cover 50 also provides containment should a fire occur within the guideway, and shields the environment from electromagnetic noise created by the system.

In reference now to FIGS. 5 and 6, the two guideway sections 40 are shown in end to end relationship with an expansion joint 42 therebetween. The expansion joint includes four fluid filled cylinders 82 fixed at their ends to the stringers 20–26 of the guideway sections 40. The cylinders 82 serve to dampen the transmission of vibration from one guideway section to the adjacent guideway section. It is expected that the cylinders 82 will be filled with heavy grease or other high viscosity liquid.

The cylinders 82 function as "shock absorbers" and will absorb low frequency vibration, transmitting high frequency vibration. As seen in FIGS. 5 and 6 the fluid filled cylinders 82 are affixed to the stringers 20–26 by bolts 81. Each cylinder 82 has a ram 83 which fits within a sleeve 85. Each ram 83 is affixed to one stringer while the corresponding sleeve 85 is affixed to the stringer across the expansion joint 42. The rams are slideable within the sleeves with their motion damped with fluid or grease as in any conventional shock absorber.

In practice, the expansion joints 42 allow thermal expansion within the guideway to take place without effecting the ride comfort or smoothness of the guideway.

Figure 8:
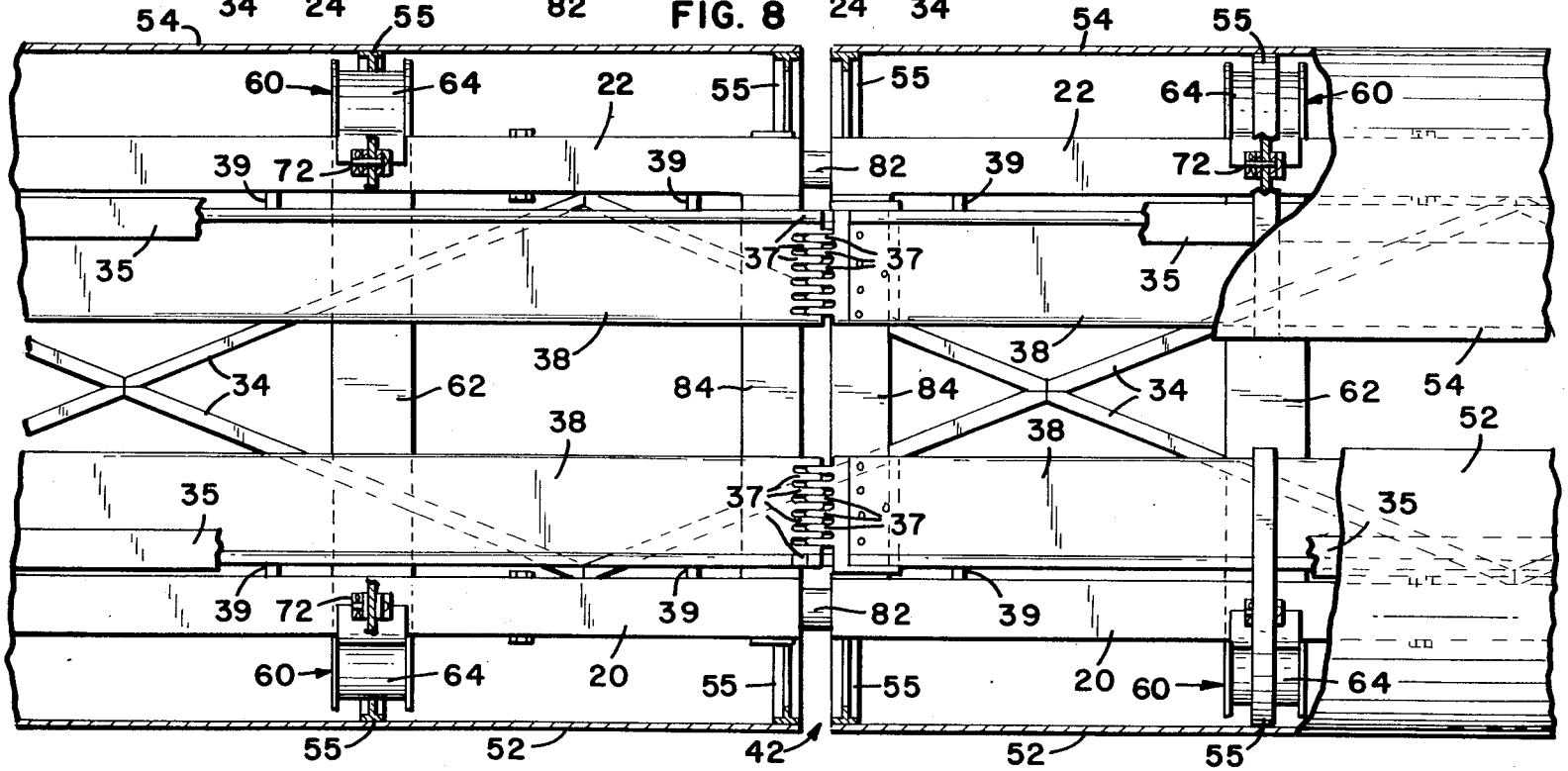
FIG. 8 is a plan view of a portion of the expansion joint shown in FIG. 6 with the covers partially shown and the support channels installed.

The expansion joints 42 further include end plates 84 which run between the upper and lower stringers 20–26 and stabilize the ends thereof. A further aspect of the expansion joints 80 is shown in FIG. 8. To provide a smooth vehicle path over the expansion joint 42, the support channels 38 are provided with support channel fingers 37 attached to the ends of the support channels 38. The support channel fingers 37 are arranged to interlock so that as the support channel sections 40 expand or contract, a smooth, continuous surface is provided for the vehicle traveling on the guideway. Similar fingers (not shown) are placed on the upper support channels 35. The smooth joint is produced by placing the expansion joint substantially at the point of zero curvature, or zero bending moment within the guideway.

Figure 9:
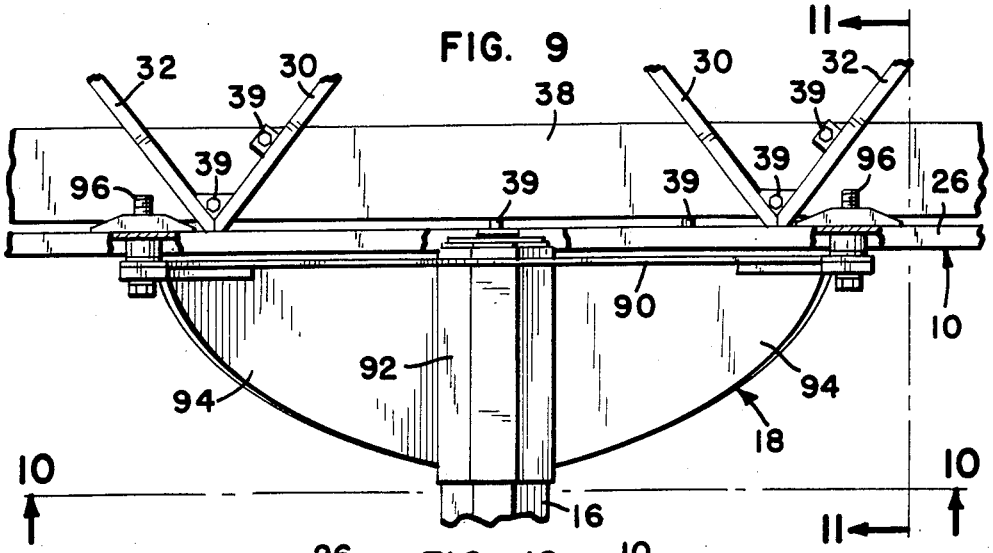
FIG. 9 is a partial elevational view on an enlarged scale showing a support post, a support post bracket and the guideway.
Figure 10:
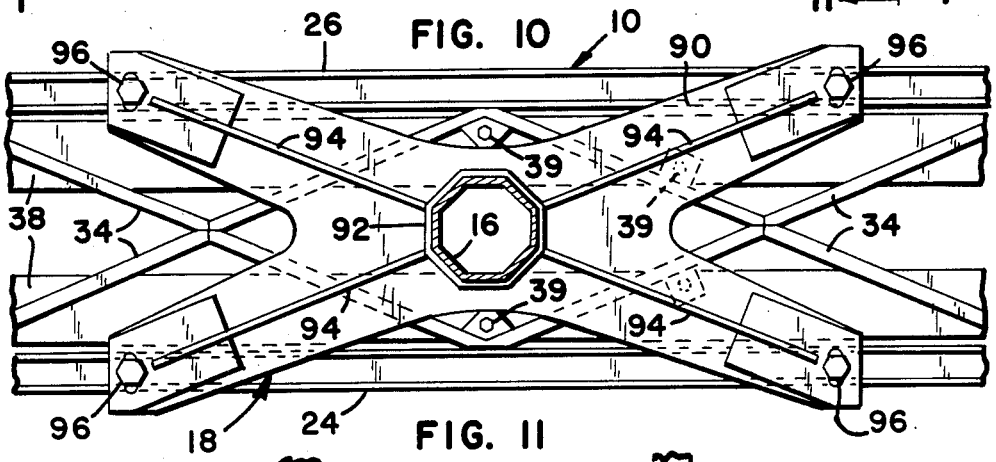
FIG. 10 is a partial sectional view on an enlarged scale taken along line 10—10 in FIG. 9.
Figure 11:
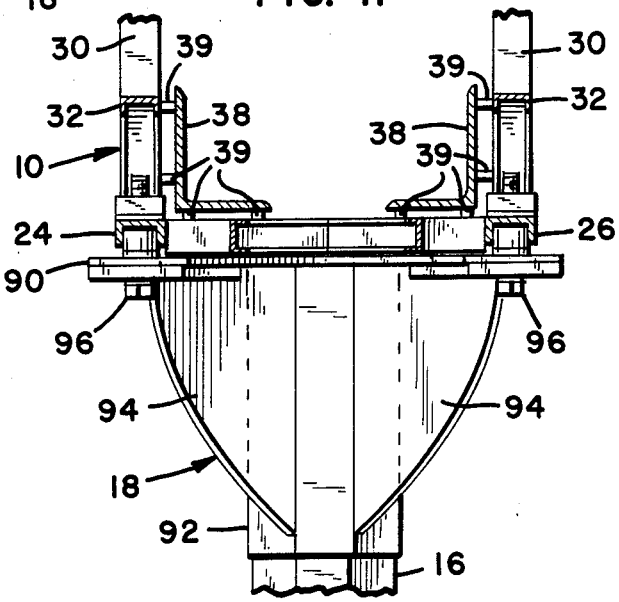
FIG. 11 is a partial sectional view on an enlarged scale taken along line 11—11 in FIG. 9.

In reference now to FIGS. 9, 10 and 11, the design of the support bracket 18 and its installation on the support posts 16 and the guideway 10 is shown. The support bracket 18 includes a generally X-shaped member 90 placed in a plane parallel to the guideway. A sleeve 92 is provided for fitting over the posts 16. A number of stiffening fins 94 are placed between the X-shaped member 90 and the sleeve 92 to stiffen the support bracket 18. The bracket itself is attached to the lower stringers 24 and 26 by bolts 96 or the like. (See FIGS. 3 and 9–11.) The bolts 96 allow the guideway section to be affixed or clamped to the support post in four places or points, each clamping place or point spaced from each adjacent point a sufficient distance to transfer torque within the guideway to the post. The distance shown is at least the distance between the lower support channels. (See FIGS. 10 and 11.)

It should be noted that the support bracket 18 and the support posts 16 are positioned along the length of the guideway section so that the support post is centered beneath a diamond shaped opening formed by the horizontal diagonal members 34. (See FIG. 10.) This positioning becomes important to an understanding of how the guideway is installed as will be described below.

It is anticipated that the preferred method for installing the guideway will include prefabricating the major components including the support posts 16, the support brackets 18, and the guideway sections 40. These components will then be shipped to the installation site which has been prepared. The support posts 16, being of uniform length, are installed at generally uniform distances along the desired path of the guideway. At this point, the support bracket 18 is installed over the top of the support posts, or the bracket can be installed prior to erecting the posts. Next, one prefabricated guideway section 40 is installed on the support post 16 and support bracket 18. The exact height of the guideway section above the ground is variable by adjusting the support bracket vertically on the post, and/or by placing shims or other spacing members between the support bracket and the guideway itself. The guideway section 40 is installed so that the support post 16 is generally centered through the diamond shaped opening formed by the horizontal diagonal members 34 approximately 21% of the distance from the end of each guideway section 40.

The guideway section 40 can then be affixed to the support bracket 18 which is slid vertically up and down on the support post 16 until the guideway 40 is at the desired height above the ground. The support bracket 18 can then be welded or otherwise affixed to the support post 16 and any excess length of the support posts 16 can be removed with a cutting torch or the like. The guideway sections can then be connected to each other with expansion joints 42 as described above. The guideway sections 40 are linked in end-to-end relationship by the expansion cylinders 82 which stabilize the ends of the guideway sections and permit the guideway to be fully supported along its length. In this way a continuous, smooth, vehicle supporting guideway is provided.

Certain materials are expected to produce satisfactory results when employed in the manufacture of the above described guideway. For example, octagonally tapered steel posts are expected to prove satisfactory for the support post 16 and common rolled steel stock is expected to perform satisfactorily for the stringers 20–26. These should, as shown, be of channel construction and should be positioned within the guideway so as not to accumulate moisture or snow. The outer reinforcing ribs 60 can be composed entirely of thin stock steel or either conventional or exotic alloys having a channel-shaped cross-section. The support channels 38 should be made of a steel right angle stock or other magnetically permeable rigid material, and it is expected that they should have an aluminum clad layer along their surface for improved interaction with the linear induction motors which propel the vehicle. (Linear induction motors are not shown in the drawings.) The covers 50 may be of aluminum or may be made of thin silicon steel alloy or reinforced fiberglass. The cover panels 52 and 54 can have a reinforcing member of steel or other material increasing their rigidity and providing convenient anchoring points for the hinges and pin points 70 and 72, respectively.

A number of characteristics and advantages of the invention have been set forth together with the structure and operation of the preferred embodiment of the guideway construction. Novel features thereof are pointed out in the following claims. The above disclosure is merely illustrative, and changes may be made in detail with respect to size, shape, choice of materials and structural arrangement within the principles of the invention to the full extent intended by the broad general meaning of the terms expressed in the claims.

What is claimed is:

1. A transportation system for use with a wheeled vehicle and a vehicle supporting guideway, said guideway comprising:

a plurality of guideway sections, each section being of substantially uniform length and affixed in end-to-end relation forming a continuous guideway, each of said sections including:

a pair of upper horizontal stringers located parallel to each other and generally defining the width of said guideway and a pair of lower horizontal stringers located parallel to each other and placed parallel to and below said upper horizontal stringers;

a plurality of vertically oriented elongated diagonal members having midpoints and affixed to said upper and lower horizontal stringers and lying in vertical planes;

a plurality of horizontally oriented diagonal members affixed to and joining each of said lower horizontal stringers;

said stringers and said diagonal members defining a guideway having an upwardly extending generally U-shaped construction;

means for elevating said guideway sections a desired distance above the ground, said elevation means located beneath said guideway sections and including a plurality of support posts, one of said posts being affixed beneath each of said guideway sections approximately 21% of the length of said guideway section from one end of said section;

a plurality of upwardly opening U-shaped reinforcing ribs spaced from each other, said ribs affixed to and substantially enclosing said stringers, said ribs in spaced relation to each other substantially along the entire length of said guideway sections said ribs having spaced inner and outer members with bar means extending therebetween, said members having joined free ends; and, means for joining a plurality of said sections in end-to-end relation forming a continuous vehicle support channel, said means including expansion joints located approximately 21% of the distance between adjacent support posts.

2. The guideway of claim 1 wherein said vertical diagonal members form a triangular pattern along said guideway, said triangular pattern including a number of said diagonal members being held under tension within said guideway and a number of said diagonal members being held under compression within said guideway and said U-shaped reinforcing ribs are spaced along the length of said sections so that said ribs are positioned to intersect and be affixed substantially to said midpoint of said diagonal members being held under compression within said guideway.

3. The guideway of claim 1 wherein said horizontal diagonal members form a diamond pattern along said guideway, said diamond pattern including generally open areas between and within said diamond pattern; said support posts are positioned vertically below said generally open areas within said diamond pattern; and said diamond pattern is positioned along said length of said section so that one of said generally open areas within said diamond pattern is positioned vertically above each of said support posts.

4. A method of installing a prefabricated vehicle supporting guideway, said guideway including a number of sections each having a pair of vehicle supporting lower support channels running substantially the length of said section, a pair of upper horizontal stringers running substantially the length of said section, a pair of lower horizontal stringers running substantially the length of said section and positioned below said upper horizontal stringers, a plurality of horizontally oriented diagonal members affixed to and joining said lower horizontal stringers and forming a diamond pattern including generally open areas, a plurality of upwardly opening U-shaped reinforcing ribs, said ribs affixed to and substantially enclosing said stringers, said ribs in spaced relation to each other substantially along the entire length of said section, said ribs having spaced inner and outer members with bar means extending therebetween, said members having joined free ends, and including means for joining a plurality of said sections in end-to-end relation; the method comprising the steps of:

(1) installing a plurality of support post means of uniform length at generally uniform distances along the desired path of said guideway;

(2) positioning one of said guideway sections over one of said post means so that said section end is positioned approximately 21% of the length of said guideway section from said post means and one of said generally open areas within said diamond pattern is positioned vertically above said post;

(3) lowering said previously positioned guideway section onto said support post means;

(4) clamping said guideway section to said support post means at four points, each of said clamping points spaced from each adjacent clamping point at least a distance equal to a distance between said lower support channels, at the desired level above the ground and cutting said post means to the desired length after affixing said section thereto;

(5) repeating steps 2–4 for the adjacent post means along said desired path with a subsequent section; and (6) affixing said sections to each other in end-to-end relation forming a continuous, smooth vehicle supporting elevated guideway.

5. The guideway of claim 1 further comprising:

a pair of main wheel support channels affixed to said guideway above said horizontal diagonal members and generally between said vertical diagonal members.

6. The guideway of claim 5 further comprising:

means for adjusting the relative position of said main wheel support channels above said horizontal diagonal members; and means for adjusting the relative position of said main wheel support channels between said vertical diagonal members.

7. The guideway of claim 1 further comprising:

means for substantially enclosing said guideway but for an upper vehicle passage slit located between said upper horizontal stringers and a lower drainage slit located between said lower horizontal stringers.

8. The guideway of claim 7 wherein said means for enclosing comprises:

a cover and means for hingedly affixing said cover to said lower horizontal stringers and means for removably attaching said cover to said upper horizontal stringers, said cover further including a plurality of individual panel members hingedly affixed in end to end relationship to substantially enclose said guideway, yet individually movable to uncover said guideway, and said panel members further including stiffening ribs having a generally T-shaped cross section, said said ribs including hinges and pin fixtures which comprise said hinge means and removable attachment means respectively.

* * * * *